United States Patent [19]

Anderson

[11] 4,270,628

[45] Jun. 2, 1981

[54] ELEVATOR DEVICE PREFERABLY AN ELEVATOR FOR BUILDING FACADES

[76] Inventor: Leif Anderson, Bögatan 39 A, S-412 72 Göteborg, Sweden

[21] Appl. No.: 889,538

[22] Filed: Mar. 23, 1978

[30] Foreign Application Priority Data

Mar. 25, 1977 [SE] Sweden ..... 7703425

[51] Int. Cl.[3] ..... E04G 3/10

[52] U.S. Cl. ..... 187/6; 182/37

[58] Field of Search ..... 187/2, 6, 7; 214/44 A, 214/77 R, 38 C, 38 A; 182/36, 37, 142; 104/94, 135

[56] References Cited

U.S. PATENT DOCUMENTS

| | | | |
|---|---|---|---|
| 2,652,785 | 9/1953 | Cox | 104/135 X |
| 3,265,450 | 8/1966 | Aho | 104/135 X |
| 3,282,377 | 11/1966 | Pfeiffer et al. | 182/36 |
| 3,347,339 | 10/1967 | Coole | 182/36 X |
| 3,854,550 | 12/1974 | Shingler | 182/36 |

*Primary Examiner*—John J. Love
*Assistant Examiner*—Norman L. Stack

[57] ABSTRACT

The present invention relates to an elevator device, preferably an elevator by a building facade and comprising a trolley which is displaceable along a track provided on a foundation, by way of example a roof, a lifting element as a lift cage, supported by the trolley means and a hoisting machinery provided for the vertical displacement of the lifting element. According to the invention the track is formed by a number of separate support elements arranged in rows preferably two rows. The support elements are along the track arranged with an interspace, which is maximum half the distance between the outer ends of the rails, corresponding to the number of rows and attached to the trolley. The rails attached to the trolley are arranged to be moved on the support elements along the track formed by the support elements. During the movement the distance between two adjacent support elements always is bridged by the rails.

4 Claims, 9 Drawing Figures

ELEVATOR DEVICE PREFERABLY AN ELEVATOR FOR BUILDING FACADES

The present invention relates to an elevator device preferably an elevator for building facades and comprising a trolley means which is displaceable along a track provided on a foundation, by way of example a roof, a lifting element, by way of example a lift cage supported by the trolley means, and a hoisting machinery provided for the vertical displacement of the lifting element.

Movable elevator devices are known from different fields. In stores and machine shops so called travelling crane installations can be found, in which a machine driven trolley can be displaced along a track. The trolley supports an elevator means for the lifting up of a load. In connection with facades of high rise buildings, a corresponding means is often found serving the purpose to facilitate the maintenance of the facade. In connection with such a facade elevator a track is provided along the one facade or the facades, which are going to be served by means of the elevator means. The trolley is provided with fastening means for wire cables, in which a lift cage is suspended. The lift cage can be vertically displaced by means of a hoisting machinery, which can be controlled from the lift cage and which can be located either in the lift cage or on the trolley. A displacement of the lift cage to different sections of the facade takes place by displacement of the trolley along its track.

In those cases, where the lift is in frequent use and the extension of the facade is not too great, such an arrangement is justified. In connection with facades of very long extension and especially in those cases, where the elevator is in mostly sporadic use, the installation cost of the track is disproportionately great. For such cases an installation of a simpler design has been suggested, in which the trolley is substituted by a frame, which is dragged or rolled over the surface of the roof along the eaves in order to obtain a sidewise displacement of the lift cage. Thus, there is not any separate track, as the frame supporting the lift case is directly displaced on the roof covering. However, such an installation can only be used, when the roof covering is of such a resistant kind that it is not damaged in connection with the displacement and the erection of the frame and it is in addition required that the roof must be almost plane, at least near to the eaves. There are also considerable risks involved that the frame will tilt over because of the weight of the lift cage being positioned outside of the supporting plane of the frame. In order to avoid this drawback without making the frame too heavy, the roof as a rule must be provided with anchoring points. Notwithstanding such a precautionary measure there is anyhow a great risk that the lift cage can crush, if the greatest care is not exercised. This together with the complicated displacement of the frame makes the sidewise displacement of the lift cage very time consuming and labourious.

It is an object of the present invention to provide an elevator device preferably intended to be used as a facade elevator, which does not require any special track, but which in spite thereof can be easily displaced in sidewise direction.

It is another object of the invention to provide an elevator device which can be displaced in sidewise direction and which does not require any special track but which in spite thereof is safe in use.

The object of the present invention is obtained by the track being formed by a number of separate support elements arranged in rows on the foundation in the longitudinal extension of the track, said rows preferably being two in number, which support elements in at least one row in the longitudinal extension of the same exhibit a predetermined maximum interspace and by the trolley means exhibiting a number of rails corresponding to the number of rows and being of a length at least corresponding to twice said maximum interspace, which rails are arranged in such a way that they can be supported by the support elements in a displaceable manner, so that the trolley by its displacement on the support elements can be displaced along the track formed by the rows of support elements, while the distance between two adjacent support element is bridged by the rails.

In the accompanying drawings an example of an embodiment of the elevator device according to the invention is shown. In the drawings FIG. 1 is a perspective view of the elevator device;

Figure 7:
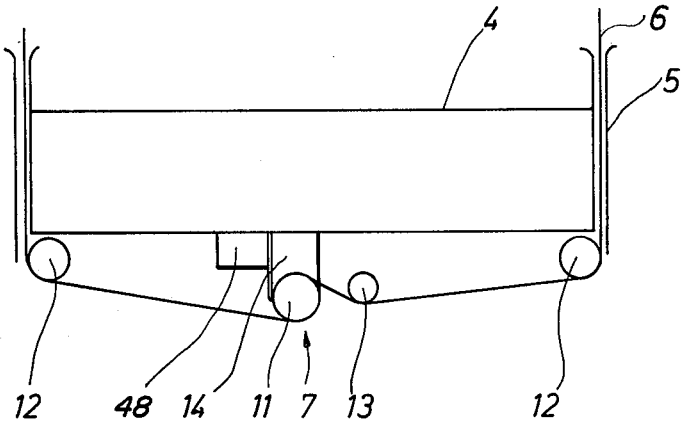

FIG. 7 schematically illustrates an additional detail and

Figure 8:
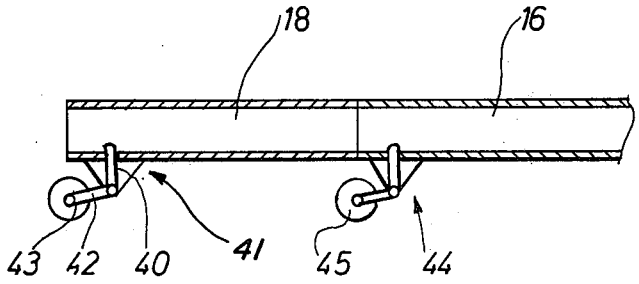
Figure 9:
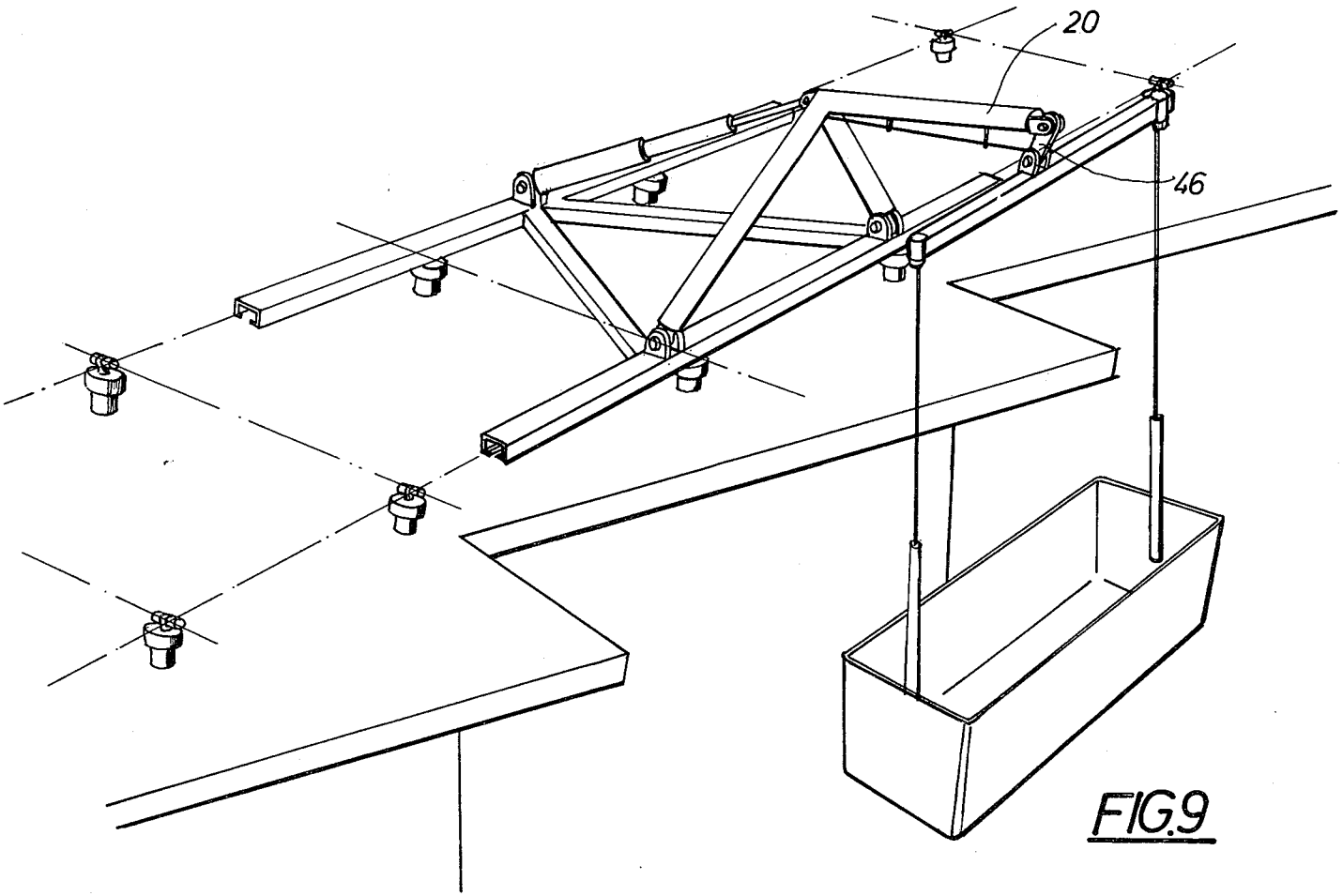

FIG. 8 schematically illustrates a safety system,

FIG. 9 is a perspective view of the elevator device in an embodiment for special use.

The elevator device is characterized by three blocks of arrangements viz. a lift cage 1, a trolley 2 and support elements 3 fastened to a foundation by means of example a roof. The lift cage can be of conventional design and be adapted to its range of application. As an example the lift cage 1 in the figures is shown to comprise the very cage 4 itself, in which a number of persons can be standing. The cage is provided with two upwards projecting tubes 5, in which steel cables 6 can run to a hoisting machinery 7 located on the underside of the cage 4. Said machinery can be operated from an operating table 8. A cable feed, not shown, is provided for the drive of the hoisting machinery 7. The cage 4 is at its underside provided with wheels 9 for its displacement on a foundation. As in the example of embodiment a facade elevator is assumed, the cage also exhibits lateral wheels 10 intended to be facing the facade, so that the cage rolls against the same. The lift cage is also schematically illustrated in FIG. 7. In addition to the details mentioned it is also evident from FIG. 7 that the hoisting machinery 7 exhibits a cable drum 11 and a number of pulley wheels 12 and 13 for the cable 6. The cable drum 11 via a driving gear 14 can be driven by an electric motor 48.

Figure 1:
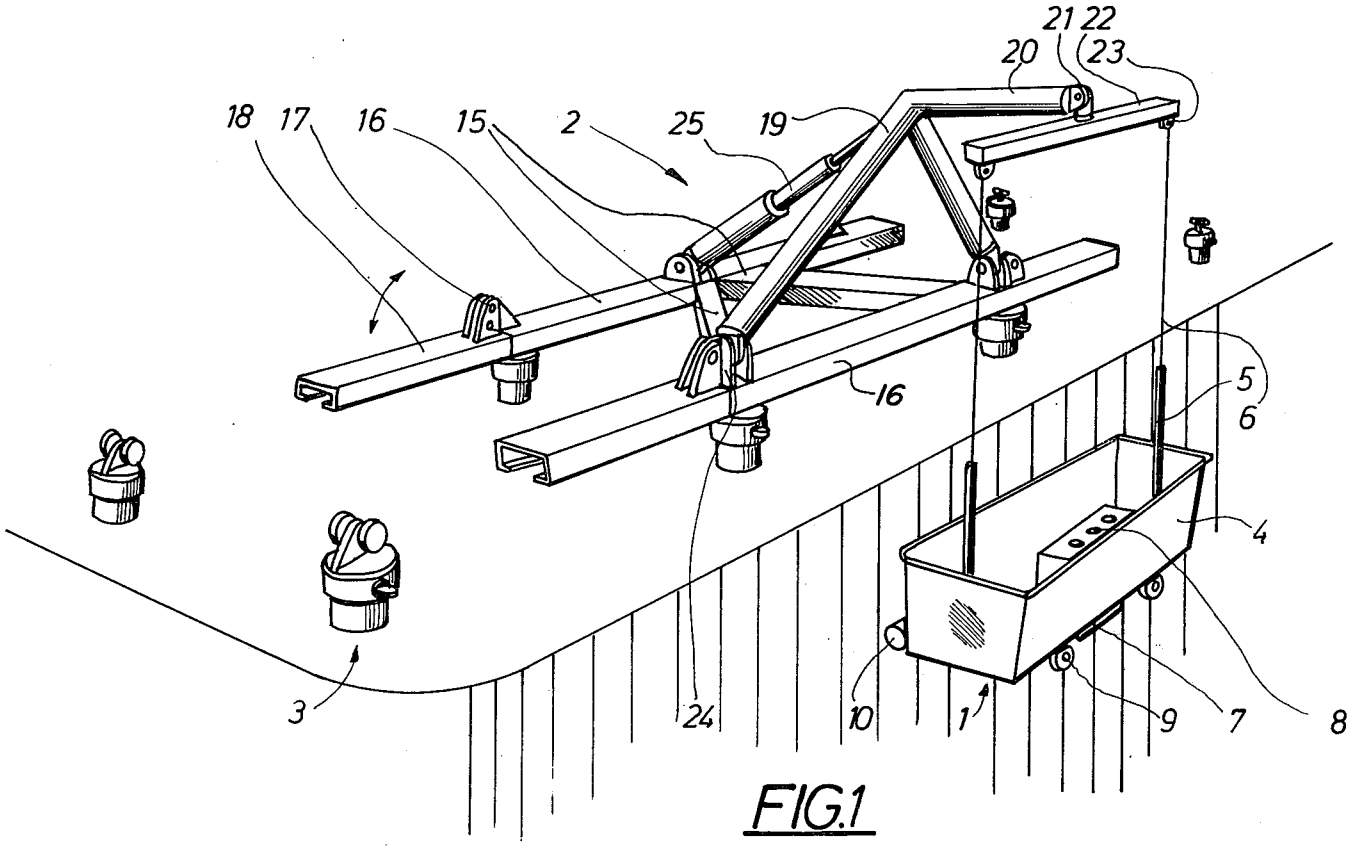
Figure 2:
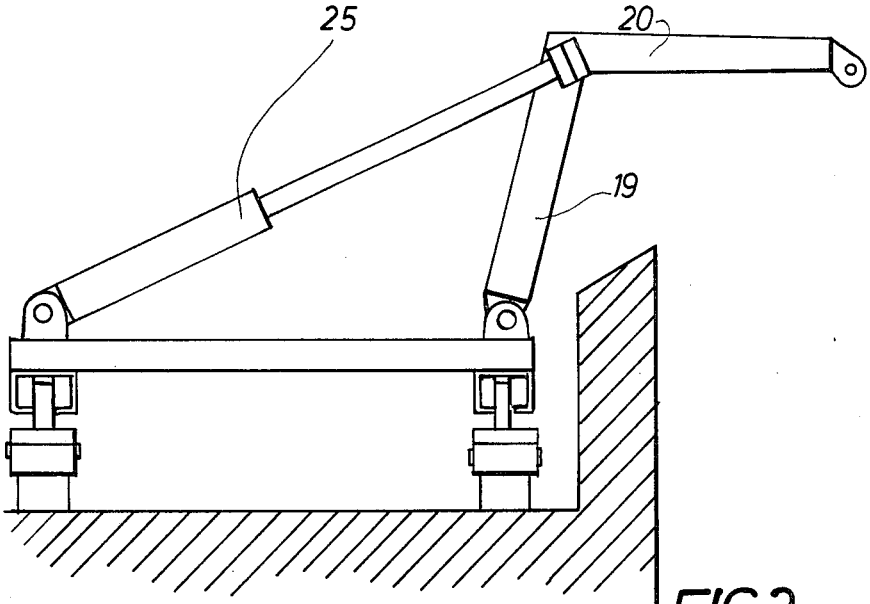
FIG. 2 is a side elevational view of the elevator device in working position and FIG. 3 is a side elevational view of the elevator device in a folded condition, in FIG. 4 the folded condition is also shown in a perspective view.
Figure 3:
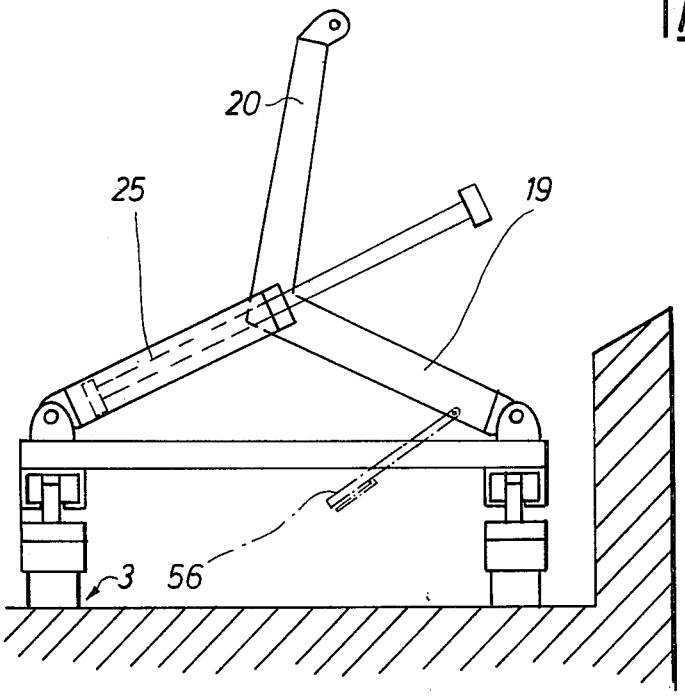
Figure 4:
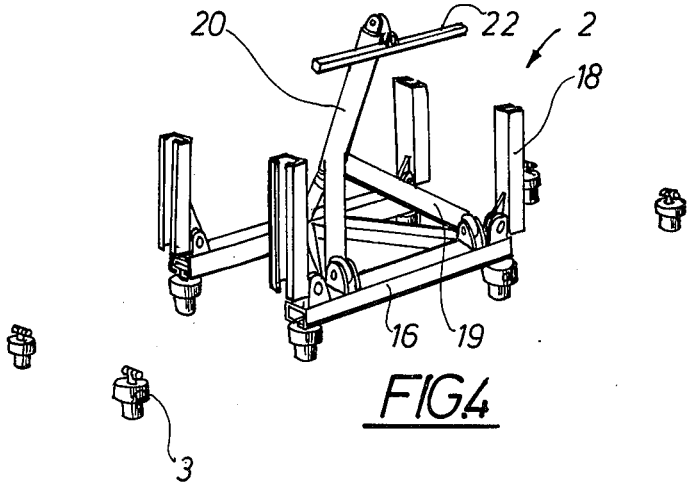
Figure 5:
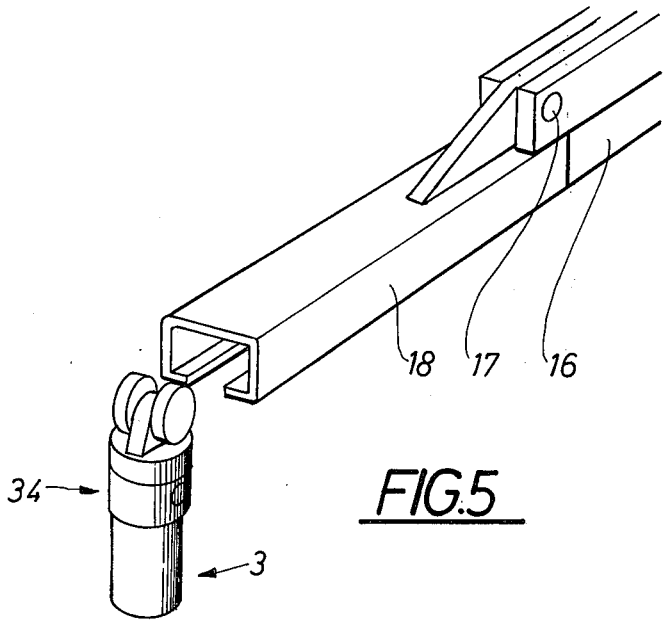
FIG. 5 is a perspective view of a detail.
Figure 6:
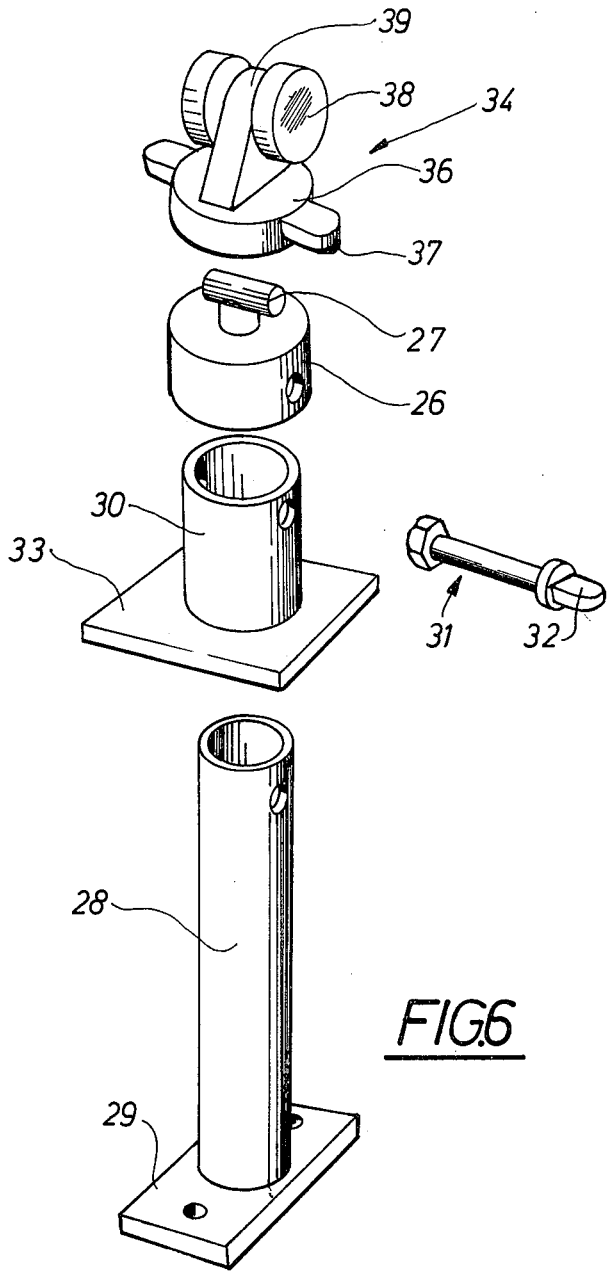
FIG. 6 is an exploded view of another detail.

The trolley 2 mentioned comprises two C-shaped rails 16 interconnected by means of cross bars 15, said rails at bearings 17 exhibiting prolonged portions 18, which can be swung in upwards direction. One rail 16 supports an Y-shaped bar 19 provided with an arm 20 in which a bar 22 with fastening means 23 for the cables 6 is pivotably suspended on a vertical shaft 21. The Y-shaped bar 19 is pivotably journalled in fastening means 24 and is designed in such a manner that by means of a telescopic link 25 attached to the other rail 16 it can be stopped in a swung-out position of the arm 20. The working position now described is evident from FIG. 2. However, the device can also occupy a storage position according to FIG. 3, in which connection the Y-shaped bar 19 is pivoted in inwards direction, so that the arm 20 points in straight upwards direction. In connection with the folding operation the telescopic link 25 is contracted. According to FIG. 3 the bar 19 can be provided with a stick 56 in order to facilitate the folding operation. The prolongation rails 18 are designed to be folded down directly in line with the rails 16 according to FIG. 1 or in the storage condition according to FIG. 4 to be pointing in straight upwards direction. The prolongation rails 18 also occupy this folded position also in connection with certain working conditions which will be treated in the following.

The supporting elements 3 are numerous and are arranged in two rows on the portion of the roof, where the trolley 2 shall be moved. In this mounting arrangement the distance from the eaves counted at right angle shall be as great as the distance between the rails 16, 18 of the trolley counted in the respective centre line and the distance in a direction parallel to the eaves should be half the distance between the ends of the prolongation rails 18 counted from the end of one prolongation rail via the principal rail 16 to the end of the other prolongation rail 18. When the space is limited, by way of example in front of a wall, the distance between the supporting elements 3 can be reduced by one half.

Each one of the supporting elements comprises a column, at the top of which a fastening means 26 is mounted, which supports a cross bar 27. The coloumn is shaped by a first tube 28 with a plate 29 intended to be mounted on a supporting building detail, and a second tube 30, which is intended to be slipped on the first tube and to be attached to the same by means of a bolt 31 with an extension 32. The tube 30 exhibits a plate 33 intended to serve the purpose of a seal. As mentioned the tube 28 shall be mounted on the supporting structure and it will consequently penetrate through the sealing covering materil, the point of penetration being tightened by means of the plate 33 which by way of example can be glued to the roof covering. The tube 30 is in its turn sealed by the cap shaped fastening means 26. Of the details mentioned it is necessary to adapt only the tube 28 with the plate 29 to the prevailing conditions, while the tube 30, the bolt 31 and the fastening means 26 always each one can be of unchanged design with the exception of the plate 33, which may require to be adapted to different roof inclinations. Said fastening means 26–32 belong to the fixed equipment on the roof and as mentioned above, they shall form rows along the intended track for the trolley 2. A limited number of roller units 34 also belong to the supporting elements and comprise each a hollow plate 36 with two wings 37. The plate 36 has a bottom with an elongated hole just permitting the passage of the bar 27 and is further provided with inner stops. The opening is directed to allow the roller unit 34 to be slipped down over the bar 27 when a shaft for two rollers 38, which by means of a supporting means 39 is rotatably carried by the plate 36, is parallel to a line, which extends from the fastening means in question to the following fastening means. The inner stops are arranged so that the roller unit 34 by means of the wings 37 can be pivoted one fourth of a whole turn, whereby the bar will occupy a position crosswise relative to the longitudinal axis of said hole. The roller unit 34 is thereby locked in the fastening means in the same way as by a bayonet clutch. The roller units are provided in such a quantity that they can be displaced by turn along the track of displacement of the trolley 2, a minimum requirement being six roller units 34. However, if one desires a displacement along an extension of greater length between each displacement of roller units, a greater number can be used. Because of the fact that the roller units can be removed, they need not be exposed to the weather conditions, the only exception being when the trolley is going to be moved.

As has been evident from the above the installation aims at providing the roof with support elements of simple design and interspaced with a relatively great distance, so that a track of displacement of the trolley can be obtained, along which it can be displaced in a simple and safe manner as if the roof would be provided with a track. However, the supporting elements represent only a friction of the cost of such a track. By the C-shaped profile of the rails 16, 18 with inwards swung edges, which engage over the rollers 38, it is in an efficient manner prevented that the trolley can be lifting by the pulling force against the arm 20. However, in order to bring about this it is assumed that the trolley is not rolled further on to supporting elements, which have not been provided with roller units 34 turned into locking position. In order to obtain this safety condition, the ends of the rails 18 are provided with a locking means, which is schematically illustrated in FIG. 8. This means comprises a lock 41, which round a shaft 40 can be turned in outwards direction but not in inwards direction, said lock supporting an arm 42 with a pulley 43 which is located outside of the end of the rail 18 and which is arranged to cooperate with one of the wings 37 of the roller unit 34. A corresponding lock is provided at the end of the rail 16 (as seen in FIG. 8) and moreover a similar lock 44 is provided, said lock, however, having its pulley 45 positioned lower down and arranged to cooperate with the projection 32 of certain ones of the bolts 31.

The function of the lifting device is the following:

When the trolley 2 is in use, it is supported by four supporting elements 3, or in a position of displacement, when its end just is going to leave a crosswise extending row formed by two supporting elements, in which position its other end just starts engaging a new crosswise extending row of two supporting elements, by six supporting elements. The lift cage 1 can be vertically displaced in conventional manner by means of a hoisting machinery 7, said cage being supported by the arm 20 of the folded out bar 19. If the facade of the building is "cogged", se FIG. 9, the position of the lift cage can be adapted to the facade in any lateral position by means of a pivoting of the bar 22. If in such connection the position of the lift cage with respect to its direction towards and away from the facade is changed, this can be compensated, if an additional link 46 (FIG. 9) is inserted between the bar 22 and the arm 20. In connection with a lateral displacement of the lift cage, the trolley 2 is rolled in sidewise direction on the roller units 34 supported by the fastening means 26–33. When the trolley, according to its movement leaves the roller units at the one side, said units are displaced to support elements on the other side in the direction of the movement of the trolley. By means of this arrangement only very few roller units are required, six units as mentioned being a minimum.

When the end of the rail 18 shall engage the rollers 38 of a roller unit, the pulley 43 (see FIG. 8) arrives in contact with a wing 37, whereby the lock 41 is moved aside by pivoting round the shaft 40. By this arrangement the insertion of the roller into the rail is made possible. If by oblivion any roller unit is not mounted on the support elements, which the rails are going to engage, the lock will not pivot aside, but takes a hold of the bar 27 preventing additional displacement in that direction. By this arrangement it is prevented that the trolley is moved outside of the rollers 38, which impede any tilting whatsoever, and it is likewise prevented that the trolley is moved outside of the track formed by the rollers and falls down towards the fastening means 26.

If the displacement track is terminating in front of a wall, the prolongation rails 18 would impede that one reaches the portion of the facade adjacent to the wall. However, in this case the prolongation rails 18 can be pivoted in upwards direction, so that the trolley can be brought closer to the wall. In such a case and also in other cases where it is a wish to move the trolley with the prolongation rails 18 in folded up condition, which by means of example can be the case in connection with feeble curves of the track of displacement, it is, however, required that the supporting elements are more closely interspaced, more particularly at an intermediate distance corresponding to one half of the distance between the outer ends of the rails 16. In such connection there will be a risk if the prolongation rails 18 are folded up and the trolley moved further on without this shorter distance between the supporting elements being established, that the trolley will tilt or fall down between the support elements. In order to prevent this risk, the ends of the rails 16 are provided with the second locking device 44, the pulley of which cooperates with the prolongations 32 of the bolts 31. However, such prolongations are only provided where the support elements are placed with said shorter intermediate distance. The lock 44 thus impedes a forwards displacement of the trolley with raised prolongation rails 18 in other places than where the shorter distance between the support elements is provided.

By means of the invention a well functioning elevator means for by way of example facade elevators has been provided, which elevator means requires substantially lower installation costs than corresponding installations provided with a fixed continuous track for sidewise displacement. The elevator means can be modified within the scope of the following claims without therefore departing from the idea of the invention. Thus, in connection with curved facades the rails can be curved, and the support elements can be placed along an arc shaped track. It is also possible to make pivoting means for the pivoting of the trolley through a certain angle at points, where the track of displacement shall be curved. The illustrated lift cage is chosen as an example only, and it can be substituted by a lifting hook or any other arrangement.

It is claimed:

1. In an elevator device having a lifting arm carried by trolley means displaceable along support means provided on an elevated foundation such as a building roof to displace a lift in the vertical and horizontal directions, the improvement comprising at least three independent support elements arranged respectively, in at least two generally parallel rows and parallel to a face of the building, the support elements of each row being disposed at a predetermined maximum spacing from each other, said trolley means being provided with rail means corresponding in number of said rows and being of a length corresponding at least to twice said maximum spacing of each respective row, said rail means being arranged to be supported by the respective support elements in a displaceable manner so that when the trolley is moved along said support elements the distance between a pair of adjacent support elements of each row is bridged by the respective rail means, and in which the rail means on the trolley is provided with outer portions which can be pivoted upwardly and serve the purpose of reducing space for the trolley, and the support elements of each row are spaced from one another respectively by a distance smaller than said maximum spacing and at most corresponding to one half of the distance between the end of the remaining operative portion of the corresponding rail means after the outer portions have been pivoted upwardly, whereby the need for a generally continuous track on said foundation is avoided.

2. In an elevator device having a lifting arm carried by trolley means displaceable along support means provided on an elevated foundation such as a building roof to displace a lift in the vertical and horizontal directions, the improvement comprising at least three independent support elements arranged respectively, in at least two generally parallel rows and parallel to a face of the building, the support elements of each row being disposed at a predetermined maximum spacing from each other, said trolley means being provided with rail means corresponding in number to the number of said rows and being of a length corresponding at least to twice said maximum spacing of each respective row, said rail means being arranged to be supported by the respective support elements in a displaceable manner so that when the trolley is moved along said support elements the distance between a pair of adjacent support elements of each row is bridged by the respective rail means, and in which the rail means is provided with outer portions which can be pivoted upwardly and serve the purpose of reducing space for the trolley, the support elements of each row being spaced from one another respectively by a distance smaller than said maximum spacing and at most corresponding to one half of the distance between the end of the remaining operative portion of the corresponding rail means after the outer portions have been pivoted upwardly, and wherein the end portions of the rail means which form the end of the operative portion of the rail, when the outer portion has been pivoted upwardly, are provided with locking means arranged to permit the movement of the rail into and past a position coincident with one of the support elements only when said support element forms a part of a section with said smaller spacing between the support elements, so that the displacement of the trolley means with rail portions pivoted upwardly is only permitted with said sections, whereby the need for a generally continuous track on said foundation is avoided.

3. In an elevator device having a lifting arm carried by trolley means displaceable along support means provided on an elevated foundation such as a building roof to displace a lift in the vertical and horizontal directions, the improvement comprising at least three independent support elements arranged respectively, in at least two generally parallel rows and parallel to a face of the building, the support elements of each row being disposed at a predetermined maximum spacing from each other, said trolley means being provided with rail means corresponding in number to the number of said rows and being of a length corresponding at least to twice said maximum spacing of each respective row, said rail means being arranged to be supported by the respective support elements in a displaceable manner so that when the trolley is moved along said support elements the distance between a pair of adjacent support elements of each row is bridged by the respective rail means, and in which the lifting arm is affixed to and projects from the trolley means for support of the lift, the free end of said arm being provided with a transverse bar pivotable along a substantially vertical axis, said transverse bar being provided with fastening means for cables for elevating and lowering the lift, whereby the need for a generally continuous track on said foundation is avoided.

4. In an elevator device having a lifting arm carried by trolley by means displaceable along support means provided on an elevated foundation such as a building roof to displace a lift in the vertical and horizontal directions, the improvement comprising at least three independent support elements arranged respectively, in at least two generally parallel rows and parallel to a face of the building, the support elements of each row being disposed at a predetermined maximum spacing from each other, said trolley means being provided with rail means corresponding in number to the number of said rows and being of a length corresponding at least to twice said maximum spacing of each respective row, said rail means being arranged to be supported by the respective support elements in a displaceable manner so that when the trolley is moved along said support elements the distance between a pair of adjacent support elements of each row is bridged by the respective rail means, and wherein the lifting arm comprises an inverted Y-shaped member having two supporting legs thereof pivotally affixed to a rail of the trolley means contiguous to the facade of a building and the third leg forming an arm bent and projecting over the facade in a normal operating position, and means connected to said lifting arm to pivot the same inwardly of the building facade to an inoperative position, whereby the need for a generally continuous track on said foundation is avoided.

* * * * *